United States Patent [19]

Thir et al.

[11] Patent Number: 4,470,914

[45] Date of Patent: Sep. 11, 1984

[54] POLYOXYALKYLENE LUBRICANTS OF IMPROVED OXIDATIVE STABILITY AND LOWER VISCOSITY

[75] Inventors: Basil Thir, Grosse Ile, Mich.; Stephen E. Eisenstein, Houston, Tex.

[73] Assignee: BASF Wyandotte Corporation, Wyandotte, Mich.

[21] Appl. No.: 441,494

[22] Filed: Nov. 15, 1982

[51] Int. Cl.[3] ..... D06M 13/18

[52] U.S. Cl. ..... 252/8.9; 252/52 A; 568/609

[58] Field of Search ..... 252/8.9, 52 A; 568/609

[56] References Cited

U.S. PATENT DOCUMENTS

| | | | |
|---|---|---|---|
| 3,164,565 | 1/1965 | Calamari | 568/609 |
| 3,544,637 | 12/1970 | Kober et al. | 568/609 |

FOREIGN PATENT DOCUMENTS

| | | | |
|---|---|---|---|
| 2833600 | 2/1979 | Fed. Rep. of Germany | 252/8.9 |
| 51-70397 | 6/1976 | Japan | 252/8.9 |
| 56-112572 | 9/1981 | Japan | 252/8.9 |

*Primary Examiner*—Maria Parrish Tungol
*Attorney, Agent, or Firm*—Bernhard R. Swick

[57] ABSTRACT

This invention relates to a process for preparing a polyoxyalkylene compound comprising reacting in the presence of a base catalyst at least one alkylene oxide with a blend of diethylene glycol and a Bisphenol A component selected from the group consisting of Bisphenol A and the reaction product of one mole of Bisphenol A with 1 to 10 moles of propylene oxide and mixtures thereof.

9 Claims, No Drawings

POLYOXYALKYLENE LUBRICANTS OF IMPROVED OXIDATIVE STABILITY AND LOWER VISCOSITY

BACKGROUND OF THE INVENTION

1. Field of the Invention

This invention relates to lubricants for synthetic fibers such as mono- and multi-filament polyester, nylon, polyolefin, poly(benzimidazole), carbon and glass yarn and particularly lubricants having improved resistance to oxidation at elevated temperatures over 200° C. and characterized by decreased viscosity.

2. Description of the Prior Art

The conversion of nylon, polyester, polyolefin, poly(-benzimidazole), carbon or glass fibers into useful yarn for textile manufacture requires the use of a lubricant formulation called the "fiber finish" or "spin finish." The spin finish must control the yarn-to-metal friction to protect the newly spun fiber from fusion or breaks and, in the case of texturing, to insure that proper twist is transferred to the yarn. Synthetic fibers must be drawn and textured or bulked to yield optimum physical properties of strength, increased covering, pleasing hand, and greater warmth. During both texturing and bulking, the yarn is exposed to high temperatures. The demand for faster throughput is now requiring temperatures that approach 220° C. or higher thus placing increased stress on the finish to protect the fiber. In the past, high viscosity products have been employed as spin finish components for high-speed texturing of polyester or nylon. However, in recent years, demand for the high viscosity products has slackened, and the fiber and yarn manufacturers are searching for low viscosity, high thermal stablity fiber finishes.

It is known to use polyoxyalkylene compounds such as block and heteric polymers of ethylene oxide and propylene oxide as spin finishes for the production of synthetic yarns. Heteric and block polyoxyalkylene compounds particularly from ethylene oxide and propylene oxide derived by polymerization with initiators such as bisphenol A and tetrahydrofuran are known as spin finishes for the production of synthetic yarns. However, such products generally are not characterized by both low viscosity and high thermal stability.

U.S. Pat. No. 4,094,797 discloses oxidation stable heteric or block copolymer polyoxyalkylene compositions suitable for the treatment of thermoplastic fibers, particularly polyester and nylon fibers, prior to the processing of such fibers. The polyoxyalkylene compounds are derived from lower alkylene oxides and can be initiated with a difunctional aromatic compound containing reactive hydrogens such as dihydroxyphenol and are capped on at least one end of the chain with an α-olefin epoxide or mixtures thereof. U.S. Pat. No. 4,134,841 discloses a fiber lubricant composition of enhanced heat stability which comprises a non-hindered polyphenol stabilizer and a polyether lubricant.

SUMMARY OF THE INVENTION

In accordance with the instant invention, oxidation stable heteric and block copolymer polyoxyalkylene products are disclosed which are useful, either alone or in admixture with other prior art polyoxyalkylene compounds, that are susceptible to oxidative degradation. The polyoxyalkylene products are characterized by a greatly reduced viscosity and are useful as lubricants for synthetic textile fibers such as polyester, nylon, poly(-benzimideazole), carbon and glass fibers.

The product of the invention is prepared by reacting in the presence of a base catalyst at least one alkylene oxide with a blend of diethylene glycol and a Bisphenol A component selected from the group consisting of Bisphenol A and the reaction product of Bisphenol A with propylene oxide wherein the mole ratio of Bisphenol A to propylene oxide ranges from about 1:1 to 1:10 and mixtures thereof. Said Bisphenol A component is reacted with the alkylene oxide or with a mixture of alkylene oxides where more than one is employed, or sequentially first with one alkylene oxide, then another such as, for example, reaction first with propylene oxide followed by reaction with ethylene oxide. It is preferred to employ as the alkylene oxides ethylene oxide with propylene oxide or butylene oxide.

DESCRIPTION OF THE PREFERRED EMBODIMENT

In the preferred embodiment, generally at least a portion of the Bisphenol A is reacted with propylene oxide in a conventional manner to produce the Bisphenol A component which is a liquid. The amount of propylene oxide may range from 1 to 10 moles per mole of Bisphenol A. The method of preparation of a reaction product of bisphenol A with a small amount of propylene oxide is well known to those skilled in the art and need not be described here. Initially, a small amount of said reaction product of Bisphenol A and propylene oxide may be employed in order to have a liquid in which to carry out the reaction after which substantially pure Bisphenol A may be added to the reaction mixture to produce the final Bisphenol A component. As is well known to those skilled in the art, the product generally referred to as Bisphenol A is 4,4′-isopropylidene diphenol.

The reaction mixture contains by weight from about 1 to 95 percent of the Bisphenol A component about 1 to 99 percent diethylene glycol and about 0.1 to 5 percent catalyst. Any conventional catalyst employed for oxyalkylation may be employed such as potassium hydroxide, sodium hydroxide, boron trifluoride di etherate and any metal oxide.

In a preferred embodiment of the instant invention, the reaction mixture contains by weight about 25 to 75 percent of the Bisphenol A component, about 25 to 75 percent diethylene glycol, and about 0.1 to 0.5 percent catalyst. The mixture is heated with slight agitation to a temperature of about 100° to 135° C. After stripping for about 15 to about 60 minutes at a temperature of about 95° to 125° C. and a pressure of less than 10 mm of mercury, the vacuum is relieved to about 0 to 5 psig with nitrogen and the alkylene oxide added over a period of about 1 to 12 hours. The reaction then proceeds until a constant pressure is observed which requires from about 1 to 4 hours. The amount of alkylene oxide, or alkylene oxides as the case may be, ranges from about 4 to 50 moles of alkylene oxide per mole of the Bisphenol A component. The preferred compounds are prepared employing ethylene oxide which may be used alone, or the Bisphenol A component-diethylene glycol blend may be reacted with either a mixture of ethylene oxide and a $C_3$–$C_5$ higher alkylene oxide or reacted sequentially with either the higher alkylene oxide followed by the ethylene oxide or vice versa. The ratio of higher alkylene oxide to ethylene oxide ranges from 0 to 10 moles per mole of ethylene oxide and, preferably, 1 to 3 moles per mole of ethylene oxide. The product produced by the reaction of the blend of the Bisphenol A component and diethylene glycol with one or more alkylene oxides is believed to be a mixture of polymers denominated by the following formulas:

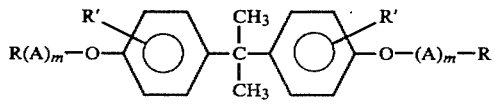

(I)

and $$R(A)_mOR \quad \text{(II)}$$

Wherein A is an oxyalkylene group selected from oxyethylene, oxypropylene, oxybutylene, oxytetramethylene and heteric and block mixtures thereof; m is a whole number selected to give an overall average molecular weight of the product of 400 to 4000, R is selected from the group consisting of H; $C_1$–$C_{20}$ aliphatic group and $$R''-\overset{\overset{\displaystyle O}{\|}}{C},$$

R′ is hydrogen, halogen, and alkyl radical of 1 to 20 carbon atoms or a carboxyl group and R″ is H or $C_1$–$C_{20}$ aliphatic group and wherein the R, R′ and R″ as appearing in the above formulae may be the same or different and m in each instance may be the same or different. In the preferred embodiment, A comprises oxyethylene groups and groups selected from oxypropylene and oxybutylene. In formula I the oxyethylene groups are attached to the oxygen that is attached to the phenol group, and the oxypropylene or oxybutylene groups are attached at the opposite end of the oxyethylene groups. In another preferred embodiment in formula I, said oxypropylene or oxybutylene groups are attached to the oxygen that in turn is attached to the phenol groups and the oxyethylene groups are attached at the opposite end of the oxypropylene or oxybutylene groups. For use as a fiber lubricant, the above-described polyoxyalkylene polymer product may be used alone or in admixture with other fiber lubricants or with water or conventional solvents.

The following examples further illustrate the various aspects of the invention. Where not otherwise specified throughout this specification and claims, temperatures are indicated in degrees centigrade and parts, percentages and proportions are by weight.

EXAMPLE 1

(Comparative Example)

To a clean, dry nitrogen filled autoclave was charged 678 parts of the reaction product of 1 mole of Bisphenol A and 7.6 moles of propylene oxide. This was heated with slight agitation to 90° C. to 100° C. after which the reactor was vented to 0 to 1 psig and 2047 parts Bisphenol A and 53 parts of 45 percent potassium hydroxide solution added. The reactor was then sealed, pressurized and purged with nitrogen. Water and volatile materials were removed by stripping at 125° C. and 10 mm Hg pressure. The vacuum was relieved through the feed line with nitrogen to 0 to 2 psig. A mixture of 9095 parts of propylene oxide and 3180 parts of ethylene oxide was added at a rate of 1400–1600 parts per hour at a pressure not greater than 90 psig and a temperature of 125° C. More specifically, when the pressure rose above 90 psig, the alkylene oxide addition was stopped and the reaction allowed to proceed until a lower pressure resulted after which more alkylene oxide was added. When the addition was complete, the reaction mixture was allowed to react until a constant pressure was achieved for 1 to 3 hours. The reaction was then allowed to cool to 80° C. and vented. The product was discharged to a nitrogen filled container after which it was deionized with 5 percent Britesorb synthetic precipitated magnesium silicate, filtered and stripped at 115° C.

EXAMPLE 2

To a clean, dry nitrogen filled autoclave was charged 596 grams of the reaction product of 1 mole of bisphenol A and 7.6 moles of propylene oxide along with 318 parts of diethylene glycol. The reactor was then heated with slight agitation to 90° C. to 100° C. and vented to 0 to 1 psig. 1847 parts of bisphenol A and 60 parts of 45 percent potassium hydroxide solution were then charged to the reactor, the reactor sealed, pressurized and purged with nitrogen. Water and volatiles were then removed by stripping at 125° C. and less than 10 mm of mercury pressure. The vacuum was relieved through the feed line with nitrogen to 0 to 2 psig and a mixture of 3907 parts of ethylene oxide and 11,332 parts of propylene oxide were added at the rate of 1400 to 1600 parts per hour at a pressure less than or equal to 90 psig as described in Example 1 and a temperature of 125° C. When the addition was complete, the reaction mixture was allowed to react to a constant pressure for 1 to 3 hours. The material was then allowed to cool to 80° C. and vented through a trap. The product was deionized with 5 percent Britesorb magnesium silicate, filtered and stripped at 115° C.

EXAMPLE 3

The procedure of Example 2 was followed with the exception that the quantities were different. More specifically, the quantities of the ingredients were 138 parts of the bisphenol A-propylene oxide reaction product, 67 parts diethylene glycol, 220 parts bisphenol A, 1684 parts propylene oxide, 592 parts ethylene oxide and 12 parts of a percent solution of potassium hydroxide.

EXAMPLE 4 The procedure of Example 2 was followed with the exception of the quantities of the ingredients. More specifically, the ingredients comprised 112 parts of the bisphenol A propylene oxide reaction product, 95 parts of diethylene glycol, 168 parts bisphenol A, 12 parts of 45 percent potassium hydroxide solution, 1726 parts propylene oxide and 899 parts ethylene oxide.

EXAMPLE 5 The procedure of Example 2 was followed with the exception that the quantities of the principal ingredients were as follows: 61 parts of the bisphenol A-propylene oxide reaction product, 86 parts bisphenol A, 148 parts diethylene glycol, 12 parts potassium hydroxide (45 percent solution), 1879 parts of propylene oxide and 626 parts of ethylene oxide.

EXAMPLE 6

(Comparative Example)

349 parts of tetraethylene glycol and 8 parts of a 45 percent potassium hydroxide solution were reacted with a mixture of 1882 parts propylene oxide and 469 parts of ethylene glycol by a procedure that was generally the same as that of Example 2.

The important characteristics of the products produced according to examples 1–6 are set forth below in Tables I–III.

TABLE I

| Example | Hydroxyl Number | Mol. Weight | Ratio of Bisphenol A to Diethylene Glycol |
|---|---|---|---|
| 1 | 78.4 | 1431 | 100:0 |
| 2 | 76.9 | 1459 | 75:25 |
| 3 | 78.2 | 1435 | 65:35 |
| 4 | 86.1 | 1303 | 50:50 |
| 5 | 77.3 | 1451 | 25:75 |
| 6 | 83.6 | 1342 | 0:100* |

*Tetraethylene glycol

TABLE II

Physical Properties of Heat Resistant Polyethers

| Example | Cloud Point* °C. | Viscosity SUS 100° F. | Smoke Point** |
|---|---|---|---|
| 1 | 23 | 1504 | 183 |
| 2 | 22.5 | 1076 | 179 |
| 3 | 20.5 | 950 | 182 |
| 4 | 21 | 803 | 283 |
| 5 | <20 | 638 | 184 |
| 6 | 57 | 481 | — |

*One percent solution
**Thin layer of material on steel block, heated by flame and first observed vapor registered as a smoke point.

TABLE III

Thermal Properties of Heat Resistant Polyethers
3.0 g Sample in Aluminum Dish, Hot Plate Test at 240° C.

| | Percent Residue | | | | | | |
|---|---|---|---|---|---|---|---|
| Example | 30 min | 2 hrs | 4 hrs | 6 hrs | 8 hrs | 24 hrs | Appearance |
| 1 | 97.6 | 93.0 | 88.6 | 84.4 | 79.4 | 49.9 | Light brown liquid |
| 2 | 98.8 | 94.7 | 88.1 | 84.0 | 78.5 | 43.1 | Brown liquid |
| 3 | 97.1 | 91.8 | 83.6 | 77.9 | 71.6 | 35.2 | Brown liquid |
| 4 | 96.1 | 87.3 | 74.7 | 66.1 | 56.9 | 22.0 | Brown liquid |
| 5 | 95.3 | 87.3 | 74.0 | 61.7 | 47.0 | 16.4 | Light brown |
| 6 | 91.3 | 70.5 | 31.2 | 7.8 | 3.5 | 1.8 | Varnish |

As can be seen from Table II, the viscosity of the product decreases with increased percentage of diethylene glycol. However, it can be seen from Table III that while increasing additions of diethylene glycol causes the thermal properties to decrease, the products remain surprisingly stable even with the product containing 75 percent diethylene glycol and 25 percent Bisphenol A. On the other hand, the product that contained no Bisphenol A, i.e., Example 6, had extremely poor properties containing only 1.8 percent residue after 24 hours.

EXAMPLE 7

A polyamide polymer is fed into a screw extruder and heated to 275° C. The molten polymer is pumped under pressure of approximately 1700 psig through a sand filter and then through the capillary of a spinnerette plate. Freshly extruded filaments are put through a descending spinning tower into which air of 70° F. temperature and 65 percent relative humidity is admitted. The filaments are gathered into yarn and upon emerging from the spinning tower, coated with the fiber lubricant solution comprising 10 percent by weight of the product of Example 4 and 90 percent of water. The lubricant coating is applied to the yarn at a rate of 0.75 weight percent based on the weight of the yarn. The yarn is then wound into a package at a rate of about 2000 feet per minute. The resulting yarn is then drawn over a one inch diameter draw pin at a delivery rate of 1536 feet per minute during which time the yarn passes over a heater maintained at 175° C. The yarn is then heat cured (employing an electric heater at 150° C. for 30 minutes) to nylon carpet backing with a latex binder.

The embodiments of the invention in which an exclusive privilege or property is claimed are defined as follows:

1. A process for preparing a polyoxyalkylene compound comprising reacting in the presence of a base catalyst at least one alkylene oxide with a blend of diethylene glycol and a Bisphenol A component selected from the group consisting of Bisphenol A and the reaction product of one mole of Bisphenol A with 1 to 10 moles of propylene oxide and mixtures thereof.

2. The process of claim 1 wherein the amount of said alkylene oxide is sufficient to give a final product having a molecular weight of from about 400 to 4000.

3. The process of claim 1 wherein said Bisphenol A component is a mixture of Bisphenol A with the reaction product of Bisphenol A and propylene oxide.

4. The process of claim 1 wherein a mixture comprising the Bisphenol A component, the base catalyst and diethylene glycol is heated in a container at about 100° to about 135° C., the container sealed, pressurized and purged with nitrogen and the volatiles removed by stripping at less than 10 mm of mercury pressure, the vacuum relieved to 0 to 5 psig and the alkylene oxide added over a period of about 1 to about 12 hours followed by reaction for about 1 to about 4 hours, the catalyst neutralized and the product stripped to remove volatiles.

5. The process of claim 4 wherein said catalyst is potassium hydroxide.

6. The process of claim 1 wherein said alkylene oxide is selected from the group consisting of ethylene oxide, propylene oxide, butylene oxide and mixtures thereof.

7. The process of claim 6 wherein the amount of catalyst is about 0.1 to 5, the amount of diethylene glycol is about 1 to 99, and the amount of Bisphenol A component is about 1 to 95 all as percent by weight of the original reaction mixture, the amount of alkylene oxide is about 4 to 50 moles per mole of Bisphenol A component and the amount of propylene oxide or butylene oxide is about 0 to 10 moles per mole ethylene oxide.

8. The process of claim 6 wherein ethylene oxide and an alkylene oxide selected from the group consisting of propylene oxide and butylene oxide are sequentially reacted with said blend.

9. The process of claim 8 wherein said alkylene oxide selected from propylene oxide and butylene oxide is propylene oxide.

* * * * *